United States Patent [19]

Pollard et al.

[11] 4,400,332

[45] Aug. 23, 1983

[54] ELECTROSTATIC DISPERSAL OF LIQUIDS

[75] Inventors: Ian E. Pollard, Grove; Keith C. Hawkins, Abingdon, both of England

[73] Assignee: The Secretary of State for Industry in Her Britannic Majesty's Government of the United Kingdom of Great Britain and Northern Ireland, London, England

[21] Appl. No.: 328,131

[22] Filed: Dec. 7, 1981

Related U.S. Application Data

[63] Continuation of Ser. No. 149,988, May 15, 1980, abandoned.

[30] Foreign Application Priority Data

May 22, 1979 [GB] United Kingdom ..... 7917791

[51] Int. Cl.[3] ..... B01F 3/04

[52] U.S. Cl. ..... 261/1; 261/DIG. 80; 261/118; 261/99; 261/DIG. 55; 123/537; 239/3; 239/695; 239/706

[58] Field of Search ..... 261/1, 118, 95, 99, 261/DIG. 80, DIG. 55, DIG. 21; 123/536–539; 239/3, 690, 695, 697, 698, 704–707; 128/202.25

[56] References Cited

U.S. PATENT DOCUMENTS

| | | | |
|---|---|---|---|
| 2,907,707 | 10/1959 | Wintermute | 261/1 |
| 3,352,545 | 11/1967 | Denine | 261/95 |
| 3,698,635 | 10/1972 | Sickles | 239/3 |
| 3,734,474 | 5/1973 | Olati | 261/95 |
| 4,034,728 | 7/1977 | Saufferer et al. | 123/537 |
| 4,085,717 | 4/1978 | Willman et al. | 123/538 |
| 4,183,339 | 1/1980 | Nagaishi et al. | 261/DIG. 80 |

FOREIGN PATENT DOCUMENTS

| | | | |
|---|---|---|---|
| 2433125 | 1/1976 | Fed. Rep. of Germany | 123/538 |
| 770619 | 9/1934 | France | 261/1 |

*Primary Examiner*—Tim R. Miles

*Attorney, Agent, or Firm*—Cushman, Darby & Cushman

[57] ABSTRACT

A liquid such as a hydrocarbon fuel is sprayed electrostatically into a gas stream. Spraying is achieved by supplying the liquid to a porous member having a plurality of termini within an electrostatic field. The electrostatic field strength is enhanced at the termini so that liquid which soaks through the porous member to the termini breaks up under the influence of the locally high electrostatic field into a stream of droplets which are repelled by their charge away from the termini. The droplets become finely dispersed in a passing gas stream.

The invention finds particular application as an electrostatic carburettor for dispersing petrol into an air stream for combustion in an internal combustion engine. The invention can also be utilized for re-dispersing fuel droplets deposited on the wall of an air/fuel intake.

19 Claims, 4 Drawing Figures

ELECTROSTATIC DISPERSAL OF LIQUIDS

This is a continuation, of application Ser. No. 149,988 filed May 15, 1980, ABN.

The present invention relates to an apparatus and a method for dispersing a liquid into a gas stream, and particularly for dispersing a fuel such as petrol into an air stream.

Liquids such as hydrocarbon fuels which have only low conductivity are difficult to disperse electrostatically by conventional spraying techniques. In electrostatic spraying processes monopolar charges are imparted to a stream of liquid which causes it to break up into fine droplets. In the case of relatively high conductivity liquids the formation of charge can occur sufficiently rapidly to allow for stable spraying but where the liquid is not a good conductor of electricity it will spend an insufficient time in the high field region to acquire enough charge to permit stable spraying to occur. This situation does not apply where the liquid is being sprayed at only a very limited rate since in these circumstances the minimal amount of charge produced at the nozzle can be taken up by the liquid even if the liquid is of only low conductivity. For example if liquid is supplied through fine capillary tubes it is possible to obtain a stable spray of a low conductivity liquid, but with such a technique it is impractical to spray liquid at reasonable rates. Certainly it will be appreciated that where, as would be the case for example with an internal combustion engine carburettor, perhaps 1000 or more capillary tubes would be required to provide the requisite maximal volume of spray, it is entirely impractical to employ such a spraying method.

The present invention seeks to provide a means of overcoming or at least mitigating these various problems of the prior art methods and apparatus. Accordingly the present invention provides, in a first aspect, apparatus for the dispersal of a liquid into a gas stream which comprises at least one porous member having a plurality of termini; means for supplying said liquid to said porous member; means for establishing an electric field in the vicinity of the termini on said member and means for directing a flow of a gas past said termini so as to entrain and remove dispersed liquid from the vicinity thereof.

In a further aspect, the invention provides a method for the dispersal of a liquid into a gas stream which comprises supplying said liquid to a porous member which has a plurality of termini, simultaneously establishing an electric field in the vicinity of the termini of such magnitude as to cause said liquid to become electrostatically charged at said termini and to be driven off from said termini as a stream of droplets; and providing a flow of a gas in which said droplets are entrained.

By the word termini is meant any projections on or projecting parts of the porous member which possess a relatively highly curved perimeter section such that an electric field at the porous member will be concentrated around said projections or projecting parts.

A preferred arrangement of the apparatus will comprise a series of porous members each possessing a plurality of termini, successive members being disposed adjacently along the line of the flow of gas. The members are preferably of a form which has termini arranged to project radially outwardly into a gas stream which passes through an annular duct surrounding the members. In some instances the porous members may be arranged to project radially inwardly into a gas stream which passes through a channel formed by apertures in the centre of the members, the members then being annular in form although this arrangement is normally less satisfactory. The porous members are conveniently of circular form but may take any suitable form in which termini are disposed to project into a passing air stream eg if the stream is constrained to a duct of rectangular section, the members may be in the form of plates having projecting termini with the plates arranged on the inner faces of the ducting so that the termini project into the gas stream. Other forms of porous member will be readily apprehended subject only to the following two considerations.

First, the members should be sufficiently porous to allow for the transmission of the liquid to be sprayed through the member to the termini, preferably without the necessity to apply a very high pressure in order to force the liquid through the member. Suitable porous materials include ceramics, naturally occurring substances such as zeolites and fabric or paper materials, eg filter papers or blotting paper. The latter are of sufficiently high pososity as not to require any substantial pressure on the liquid to achieve a reasonable flow rate for spraying. Sinterered metals may also prove satisfactory.

The flow rate of liquid which can be converted to a spray at any given terminus is dependent on the strength of the field at the terminus provided that the field strength is above the minimum required for spraying to be achieved. Therefore the second factor which has to be considered in the design of porous members is the nature of the applied electric field in the system.

Essentially the electric field should be sufficiently strong and of a form such that the necessary field strength for dispersal of the liquid to a spray will be reached in the vicinity of the termini of the porous member(s). The necessary field strength must be above a minimum field strength which is dependent on the electrical resistivity of the liquid and which may be a reflection of a variation in charging times with electrical resistivity of the liquid. The minimum field strength at which spraying will occur, is lowered in the presence of some substances, eg water, whether contained in the liquid itself or in the atmosphere into which the liquid is being sprayed. In a modification of the apparatus of the invention therefore means are provided for simultaneously introducing into the flow of liquid to be sprayed a substance, either as a liquid or as a solution, which will lower the minimum value of the field strength at which stable spraying takes place. It is not necessary that the liquid and added substance be mixed together before arrival at the spraying site.

Under the most favourable circumstances the minimum field strength needed to achieve spraying will be about 100 KV/m but for a liquid of relatively high resistivity like petrol the minimum field strength required is more typically about 1 MV/m. An upper limit on the field strength is set by the level at which a corona discharge is formed in the gas. For example in air this will occur at about 3 MV/m and the operational field strength in the process of this invention should be kept below the limit necessary to avoid corona discharge.

Within the limits on field strength mentioned, any value may be chosen but it should be noted that the higher the field strength the smaller will be the droplet size in the resulting spray. As a general rule it will be preferred that the droplet size should be as small as possible since this reduces the likelihood of the droplets falling to the walls of the gas flow duct, to which they will tend to be attracted in order that the electrostatic charges upon the droplets can be discharged. This tendency will also be reduced by increasing the rate of gas flow as much as possible. This can be done by keeping the gas flow duct as narrow as possible but this will of course at the same time bring the spraying termini closer to the duct walls and thereby counteract to some degree the advantage of the higher flow rate. All of these factors have to be kept in mind when designing apparatus in accordance with the invention and having regard to the resistivity of the liquid which it is desired to spray and to the mass rate at which it is to be sprayed as well as to the flow rate of the gas stream into which the liquid is to be sprayed.

It may be possible to charge alternate members of a series of porous members with positive and negative polarity or indeed to alternately charge the same porous member with opposite polarity as by using an AC supply thereto. By this means a spray having an overall neutral polarity should result and in this event there would be no tendency for individual droplets to be attracted to the walls of the gas flow duct. This would reduce or avoid the constraint on the design and operation of the apparatus in respect of the necessity to avoid deposit of the droplets at the duct walls. However, the pressure of oppositely charged particles in the stream gives rise to the possibility of re-coalescence which could be a considerable disadvantage if it occurs on a substantial scale.

In regard to the whole of the preceding discussion of the factors which determine the field strengths which should be applied in the case of the apparatus and process of this invention it should be appreciated that it is only necessary to achieve the relevant field strength in the vicinity of the termini since it is at the termini that charging and dispersal will tend to occur. Although it may be possible to spray from a porous member which has no termini, it will be necessary in that case to apply a very much higher voltage to the member in order to achieve the necessary field strength at all points on the member boardering the air stream. For liquids of high resistivity there would then be a greater likelihood of a corona discharge occurring and furthermore it would be extremely difficult if not impossible to achieve even spraying around the whole interface of the member if spraying took place at all. By providing termini on the member, highly advantaged loci are created at which charging and dispersal of the liquid may preferentially and consistently take place.

It follows from the above that the termini should be spaced apart sufficiently to ensure that each will form an independent spraying locus which means essentially that each terminus should be sufficiently spacially independent as to give rise to a locally elevated field strength in its vicinity. Where two termini are set too closely together the field strength will average over the two and only one effective terminus will then be available ie corresponding to one peak in the field strength.

It has been found in practice that, for a linear array of termini, a mutual separation of about 2 mm is the minimum which is possible whilst maintaining stable spraying from any two adjacent termini. With a two dimensional array of termini it has been found that a wider spacing is required, preferably several times wider, apparently because the termini around the periphery of the array to some degree "shield" those towards the centre of the array. As a consequence the field strength over the latter termini is somewhat averaged out and the necessary full strength peaks can only be achieved by spacing the termini by somewhat more than the minimum theoretical uni-directional separation. Although it is generally quite convenient to provide such enlarged spacings so as to compensate for the shielding effect of peripheral termini on the central termini, in an array of termini another approach which could be used would be to provide an enhanced field strength generally in the vicinity of the innermost termini of the array, eg where the array consists of a stack of physically separated members, by applying a higher potential to the inner members of the stack (or indeed a series of higher potentials depending on the position of the member within the stack) than to the outermost members. It will be readily appreciated by those skilled in the art that a variety of such manipulative arrangements may be employed in order to vary the field strength selectively over an array of termini and in general the geometry of the field and of the array should be chosen in concert so as to give the desired field strength at each terminus of the array with the input of the minimal energy required overall to maintain the necessary field. Such aspects of field design are generally within the scope of the skilled worker in the art and will not be elaborated on further herein.

The porous members conveniently form one pole of the electric field with othe other pole being a part of the casing or ducting of or support for the apparatus. It is preferred that when the apparatus has a cylindrical form, the porous members be situated close to the axis of the apparatus rather than around its periphery. This is because, as a result of the attenuation of the field away from an axial pole there is a danger that, in order to establish a sufficiently strong field in the vicinity of a peripherally situated porous member, the field at the axial pole would exceed the breakdown point of the atmosphere in which case a corona discharge would be set up and spraying would not then take place.

In a similar manner it will be apparent that as the spacing between the two poles of the field is diminished the tendency for a spark to be established across the gap will be increased and therefore a practical minimum is set for this dimension. Where the poles are formed respectively by the porous members and by the ducting for the gas flow passing the members, as may frequently be the case, then the gap between the poles may in fact be determined rather by the capacity of the channel which is required for passage of air through the apparatus and may be found, for this reason, to be of necessity somewhat larger anyway than the gap at which there is a danger of sparking taking place.

In the context of dispersing hydrocarbon fuels such a petrol into an air stream, the apparatus and method of this invention are particularly applicable to the design of internal combustion engine carburettors and/of equipment for dispersing fuel from regions in an internal combustion engine where it tends to collect eg the inlet manifold thereof. For these applications the apparatus and method of the present invention provides the possibility of achieving a more homogeneous and better dispersal than is possible with equipments used heretobefore. In particular it is anticipated that the droplets produced will be smaller over a wider range of operating conditions of the engine than with conventional equipments. There is a great advantage in being able to obtain such fine dispersion of the fuel for an internal combustion engine since it makes operation more efficient leading to enhanced fuel economy and, as a result of the more complete combustion achieved, pollution emission is considerably reduced. This is per se desirable but may also obviate the need for fitting very expensive pollution control equipment to internal combustion engine vehicles.

A further advantage associated with electrostatic dispersal systems is their ease of control and in particular the ease with which they may be incorporated into a control circuit. In the case of application to an internal combustion engine this means that the engine performance and output could be matched very precisely to the work demanded of the engine through electronic feedback circuitry, for example to vary the carburettor field strength in accordance with instructions from a microprocessor unit. In this way optimum engine performance including a very high level of responsiveness could be ensured under all conditions of engine demand, and this would lead to enhanced fuel economy compared with the conventional internal combustion engine and controls.

In order that the invention may be more fully understood embodiments thereof will now be described with reference to the accompanying drawings in which.

Figure 1:
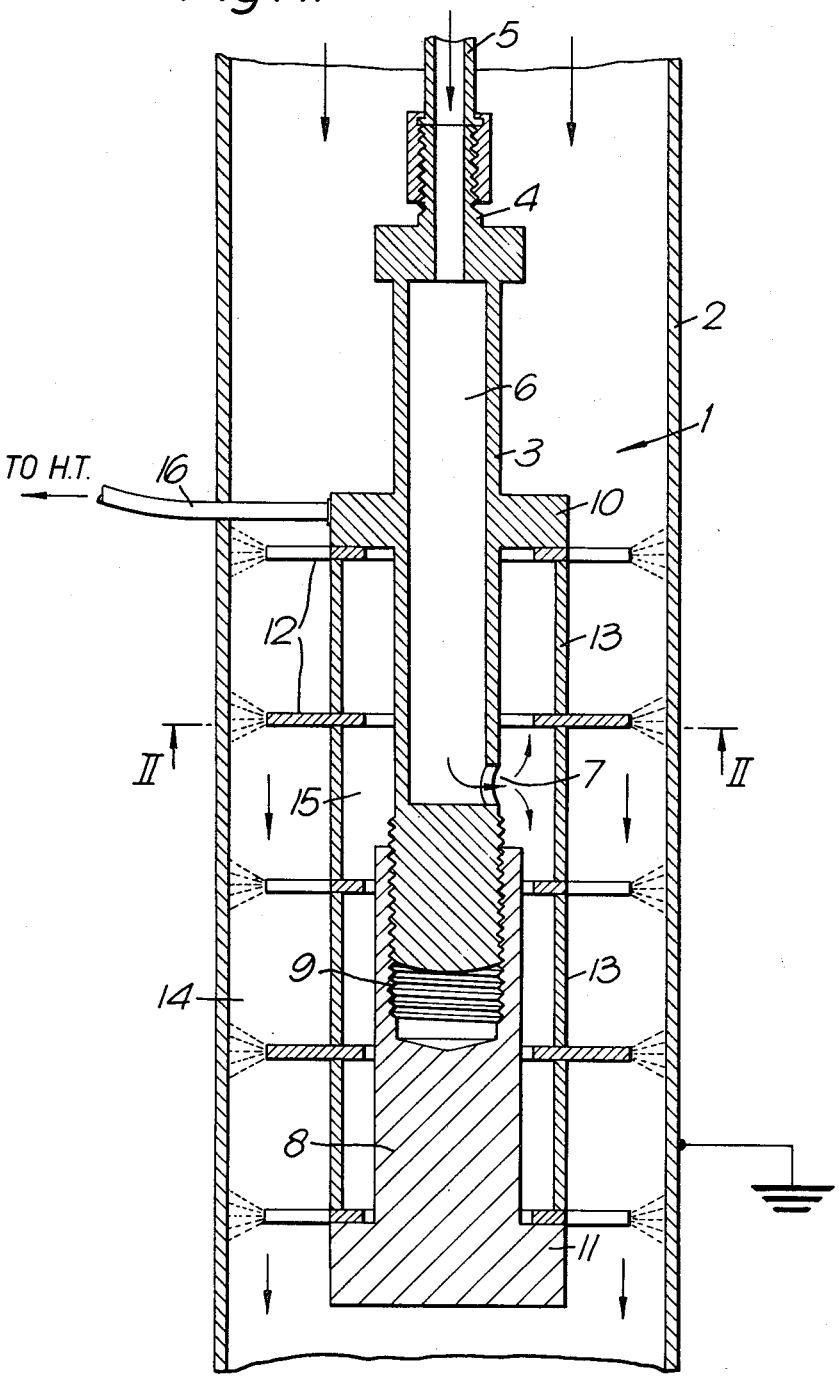
FIG. 1 is a view in section of apparatus of this invention in the form of a carburettor for an internal combustion engine.
Figure 2:
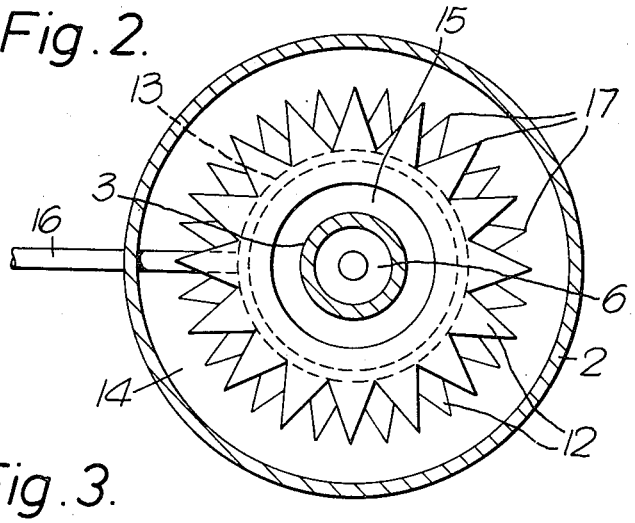
FIG. 2 is a section along 2—2 of FIG. 1.

In the drawings, FIG. 1 shows an internal combustion engine carburettor device indicated generally at 1. The device is situated in an air duct 2 of the conventional type and is supported co-axially therein by spiders (not shown). The carburettor comprises a first body member 3 which includes a fitting 4 for attachment of a fuel line 5. The body member 3 has an axial bore 6 which is open to fuel line 5 and which terminates in an aperture 7 in the wall of the body member near to its opposite end. The end portion of the first body member is threaded externally and is screwed into an internally threaded bore 9 formed in one end of a second body member 8. The two body members 3 and 8 have respectively flanges 10 and 11 between which are clamped in alternating sequence, a series of porous spraying members 12 and spacer rings 13. An annular passageway 14 is thus formed between the duct 2 and the surface presented by spacer rings 13 and flanges 10 and 11 into which spraying members 12 project. As best seen in FIG. 2, the spraying members 12 are of generally annular form and each have a plurality of termini 17.

Between the inner surface of the rings 13 and the first body member 3 is an annular chamber 15 through which fuel, exiting through aperture 7 can pass to the various porous spraying members. The wall of the duct 2 is earthed as indicated and a high tension lead 16 is provided to flange 10. Short by-pass leads (not shown) ensure that all the spacer rings are at the same potential.

In use the high tension lead is energised and the flows of air and fuel commenced in the conventional manner. The fuel is drawn through supply line 5, bore 6, aperture 7 and chamber 15 into the spraying members and by virtue of the enhancement of the electrostatic field occurring there, is converted to a fine spray at the termini 17. As the fuel is dispersed in this way, further fuel is supplied to the termini 17 by capillary action of the porous members 12. If desired, the capillary action can be augmented eg by hydrostatic pressure. This spray is entrained by the air flow being drawn through annular duct 14 and the fuel/air mixture is passed on, via the throttle valve, to the cylinders of the engine in the conventional manner.

As to dimensions, the tips of each porous member typically lie about 2 mm apart whilst the porous members themselves may be spaced apart by between 4 and 10 mm.

Figure 3:
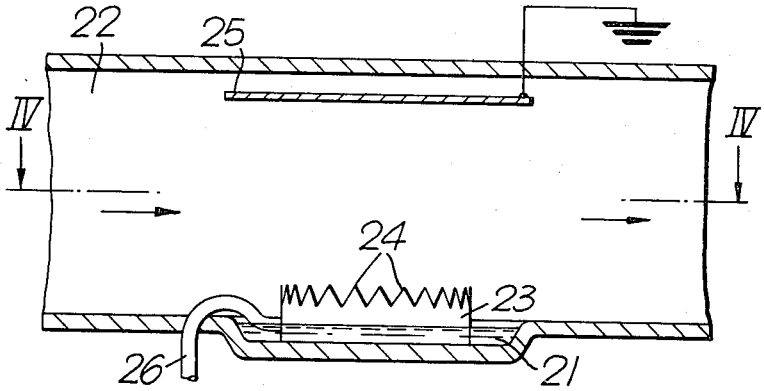
FIG. 3 is a view partly in section of apparatus of this invention in the form of a device for dispersing liquid fuel from a pool thereof in the inlet manifold to an internal combustion engine.
Figure 4:
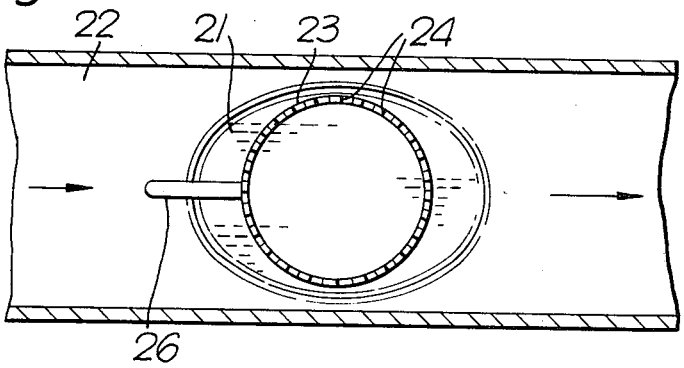
FIG. 4 is a part sectional view on a line 4—4 in FIG. 3.

The embodiment of apparatus of this invention which is shown in FIG. 3 is designed to effect re-dispersal of fuel which has been deposited from an air stream such as that issuing from a carburetor. For example it is often found in internal combustion engines that fuel will separate out of the air suspension onto surfaces of the air/fuel inlet system particularly in the vicinity of the inlet manifold where the flow is divided. In this region precipitated fuel collects in a pool of liquid and may, under adverse conditions, enter the cylinders as a transient slug of liquid fuel. Such fuel is effectively wasted and furthermore, as a result of the over-rich mixture there is incomplete combustion which is undesirable. There is therefore a requirement for some means of continuously re-dispersing such deposited fuel into the air stream just prior to its passage to the cylinders of the engine. Such a means is shown in FIG. 3 of the drawings as comprising a sump 21 in the air/fuel inlet duct or manifold 22 into which liquid fuel can drain. Situated within sump 21 is an annular porous member 23 including termini 24 extending into the air stream. Towards the opposite side of the duct or manifold from the porous member a metal plate 25 is situated. The metal plate is earthed whilst a high potential is applied to the porous member through an electrical lead 26.

In operation a flow of air and dispersed fuel passes through duct or manifold 22 in the direction shown by the arrows in FIG. 3. Any liquid fuel which is deposited at the walls of the duct or manifold collects in the depression 21 formed in the floor of the duct or manifold and from there is drawn up to the tips 24 of the porous spraying member 23 by capillary action. Under the influence of an electric field imposed between the porous member and the earthed plate 25, the fuel is re-dispersed from tips 24 into the passing air/fuel stream.

In some instances it may occur that fuel droplets are deposited around the entire periphery of a duct, but tend to be re-dispersed as undesirably large droplets before the quantity is sufficiently large to run down and accumulate in a sump. In this situation a modification of the arrangement shown in FIGS. 1 and 2 may be useful. In such a modification it is envisaged that a wick structure should be disposed in contact with the duct walls in the area where droplet deposition is anticipated. The wick structure should be so arranged as to conduct the deposited liquid to a spraying structure having one or more spraying members such as 12 maintained at high potential relative to the duct walls and having termini from which spraying can occur to re-disperse the liquid.

Although use of the apparatus and method of the invention have been particularly described in terms of the dispersal of fuel into the air intake for an internal combustion engine, the invention is not to be considered as being in any way limited to this particular use or system but rather may be employed in any situation where it is desired to spray a liquid into a gas stream.

We claim:

1. Apparaus for the dispersal of liquid into a gas stream, comprising:

at least one member formed of inherently porous material and being sufficiently porous that the liquid can soak therethrough and having a plurality of termini;

means for supplying said liquid to said porous member;

means for establishing an electric field in the vicinity of the termini on said porous member, said electric field causing liquid at said termini to be electrostatically dispersed from said termini; and means for directing a flow of gas past said termini so as to entrain and remove liquid electrostatically dispersed from said termini.

2. Apparatus for dispersing liquid into a gas stream, comprising a plurality of porous members each such member being of generally annular form, each member having a plurality of termini directed radially therefrom;

a plurality of tubular members, located one between each pair of adjacent annular porous members, means for holding the porous members and tubular member together to create an assembly defining a fluid reservoir therein;

means for supplying said liquid to said reservoir;

means for establishing an electric field in the vicinity of the termini on each of said porous members said electric field causing liquid at said termini to be electrostatically dispersed from said termini; and an annular duct wall surrounding said assembly of porous members and tubular members for constraining said gas stream to flow in the space between the duct wall and the assembly of porous members and tubular members for entraining and removing liquid electrostatically dispersed from termini.

3. A carburetor for dispersing a liquid fuel into a gas stream comprising:

at least one member formed of inherently porous material and sufficiently porous that said liquid fuel can soak therethrough and having a plurality of termini;

means for supplying said liquid fuel to said porous member;

means for establishing an electric field in the vicinity of the termini on said porous member, said electric field causing liquid at said termini to be electrostatically dispersed from said termini; and means for directing a flow of gas past said termini so as to entrain and remove liquid fuel electrostatically dispersed from said termini.

4. Apparatus according to claim 3, comprising a series of porous members each porous member having a plurality of termini, successive members being disposed adjacently along the line of flow of the gas.

5. Apparatus according to claim 3 wherein the termini are separated by at least 2 mm.

6. Apparatus according to claim 3 wherein the porous members are of a material selected from the group comprising ceramics, zeolites, fabrics, paper and sintered metals.

7. Apparatus according to claim 3 wherein the gas is constrained to flow within a duct and the termini of each porous member project radially outwardly into the duct.

8. Apparatus according to claim 7 wherein the duct is of substantially circular cross-section and the termini project radially outwardly into the gas which is constrained to flow between the duct and each porous member.

9. Apparatus according to claim 3 wherein said means for directing a flow of gas comprises a duct having walls within which the gas is constrained to flow and wherein the means for supplying said liquid comprises a sump into which liquid deposited on the duct walls can drain.

10. Apparatus according to claim 9 wherein the porous member extends into the sump and liquid therein is drawn to the termini by capillary action.

11. A method of dispersing liquid into a gas stream, comprising the steps of:

supplying the liquid to a member formed of inherently porous material and having a plurality of termini; permitting the liquid to soak through the porous member to the termini;

simultaneously establishing an electric field in the vicinity of the termini, the field having such a magnitude as to cause said liquid to become electrostatically charged at said termini and to be driven off from said termini as a stream of droplets; and providing a flow of gas past said termini so as to entrain said droplets within said flow of gas.

12. A method as claimed in claim 11 further comprising the step of drawing the liquid through the porous member to the termini by capillary action.

13. A method as claimed in claim 11 wherein said step of establishing an electric field comprises the step of establishing a cyclically varying electric field.

14. A method as claimed in claim 11 wherein said step of establishing an electric field comprises the step of establishing an electric field having a magnitude of at least 100 KV/m.

15. A method as claimed in claim 14 wherein said step of establishing an electric field comprises the step of establishing an electric field having a magnitude on the order of 1 MV/m.

16. A method as claimed in claim 11 wherein said step of providing a flow of gas comprises the step of providing a flow of air.

17. A method as claimed in claim 16 wherein said step of establishing an electric field comprises the step of establishing an electric field having a magnitude less than about 3 MV/m.

18. A method as claimed in claim 16 wherein said step of supplying the liquid comprises the step of supplying a hydrocarbon fuel.

19. A method as claimed in claim 18 wherein said step of supplying the liquid comprises the step of supplying petrol.

* * * * *